US010951970B1

(12) United States Patent
Struzik et al.

(10) Patent No.: US 10,951,970 B1
(45) Date of Patent: Mar. 16, 2021

(54) OPEN AUDIO DEVICE

(71) Applicant: Bose Corporation, Framingham, MA (US)

(72) Inventors: Ryan C. Struzik, Hopkinton, MA (US); Michael W. Stark, Acton, MA (US); David J. Fustino, Worcester, MA (US); Allen T. Graff, Sutton, MA (US); Daniel Patrick Baker, Warwick, RI (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/567,146

(22) Filed: Sep. 11, 2019

(51) Int. Cl.
*H04R 1/10* (2006.01)

(52) U.S. Cl.
CPC ..... *H04R 1/1008* (2013.01); *H04R 1/1041* (2013.01); *H04R 1/1075* (2013.01); *H04R 2420/07* (2013.01); *H04R 2460/09* (2013.01)

(58) Field of Classification Search
CPC .. H04R 1/1008; H04R 1/1041; H04R 1/1075; H04R 2420/07; H04R 2460/09
USPC ..... 381/74, 370, 373, 374, 381
See application file for complete search history.

(56) References Cited

U.S. PATENT DOCUMENTS 6,301,367 B1 * 10/2001 Boyden ..... A42B 1/245 2/209
2018/0167710 A1 * 6/2018 Silver ..... H04R 1/1075

FOREIGN PATENT DOCUMENTS

WO 2019164553 A1 8/2019

* cited by examiner

*Primary Examiner* — Vivian C Chin
*Assistant Examiner* — Douglas J Suthers
(74) *Attorney, Agent, or Firm* — Brian M. Dingman; Dingman IP Law, PC

(57) ABSTRACT

An open audio device includes a housing and an acoustic radiator in the housing and that emits front-side acoustic radiation from its front side and emits rear-side acoustic radiation from its rear side. A front acoustic cavity in the housing receives front-side acoustic radiation, wherein the housing defines a front sound-emitting opening. A rear acoustic cavity in the housing that receives rear-side acoustic radiation, wherein the housing defines a rear sound-emitting opening. A support structure is configured to carry the housing on a user's head such that the housing is held proximate an ear of the user with one of the front or rear sound-emitting openings anterior of and proximate the tragus of the ear. The housing comprises an inner end that is configured to be closest to the user's head. The one of the front or rear sound-emitting openings that is anterior of and proximate the tragus of the ear lies at an angle to the inner end of the housing.

19 Claims, 4 Drawing Sheets

OPEN AUDIO DEVICE

BACKGROUND

This disclosure relates to an audio device that is configured to be worn on or abutting the ear.

Wireless headsets deliver sound to the ear. Most wireless headsets include an earbud that is placed into the ear canal opening. Earbuds can inhibit or prevent the user from hearing speech and ambient sounds. Also, earbuds send a social cue that the user is unavailable for interactions with others.

SUMMARY

All examples and features mentioned below can be combined in any technically possible way.

In one aspect, an open audio device includes a housing, and an acoustic radiator in the housing that emits front-side acoustic radiation from its front side and rear-side acoustic radiation from its rear side. A front acoustic cavity in the housing receives front-side acoustic radiation. The housing defines a front sound-emitting opening. A rear acoustic cavity in the housing receives rear-side acoustic radiation. The housing defines a rear sound-emitting opening. A support structure is configured to carry the housing on a user's head such that the housing is held proximate an ear of the user with one of the front or rear sound-emitting openings anterior of and proximate the tragus of the ear. The housing comprises an inner end that is configured to be closest to the user's head. The one of the front or rear sound-emitting openings that is anterior of and proximate the tragus of the ear lies at an angle to the inner end of the housing.

Examples may include one of the above and/or below features, or any combination thereof. The one of the front or rear sound-emitting openings that is anterior of and proximate the tragus of the ear may extend along an opening height relative to the inner end of the housing and may be defined between an opening bottom edge that is closest to the housing inner end and an opening top edge that is farther from the housing inner end. The opening bottom edge may be more anterior than the opening top edge. The housing may further comprise a sidewall that is configured to face the tragus. The sidewall that is configured to face the tragus may be curved. The one of the front or rear sound-emitting openings that is anterior of and proximate the tragus of the ear may extend along the curved sidewall of the housing.

Examples may include one of the above and/or below features, or any combination thereof. The housing may be cylindrical. The inner end of the housing may comprise an inner end wall that is configured to lie against the side of the user's head proximate the ear and anteriorly of the tragus, and the housing may further comprise a curved sidewall that is configured to be located proximate the tragus. The one of the front or rear sound-emitting openings that is anterior of and proximate the tragus of the ear may be formed by a chamfer at an intersection of the sidewall and the inner end wall of the housing. The curved sidewall may have a circumference, and the one of the front or rear sound-emitting openings that is anterior of and proximate the tragus of the ear may extend around no more than about 40% of the sidewall circumference. The one of the front or rear sound-emitting openings that is anterior of and proximate the tragus of the ear may be located at least in part in the sidewall of the housing. The one of the front or rear sound-emitting openings that is anterior of and proximate the tragus of the ear may also be located in part in the inner end wall of the housing.

Examples may include one of the above and/or below features, or any combination thereof. The one of the front or rear sound-emitting openings that is anterior of and proximate the tragus of the ear may comprise the front sound-emitting opening in the housing. The open audio device may further comprise a separate rear sound-emitting opening in the housing. The rear sound-emitting opening may be configured to be farther from the tragus than is the front sound-emitting opening. The open audio device may further comprise a screen over the one of the front or rear sound-emitting openings that is anterior of and proximate the tragus of the ear, to inhibit the ingress of contaminants. The screen may be curved along a length dimension. The screen may define a developable surface. The one of the front or rear sound-emitting openings that is anterior of and proximate the tragus of the ear may have an area of about 55 $mm^2$.

In another aspect, an open audio device includes a housing and an acoustic radiator in the housing that emits front-side acoustic radiation from its front side and rear-side acoustic radiation from its rear side. A front acoustic cavity in the housing receives front-side acoustic radiation. The housing defines a front sound-emitting opening. A rear acoustic cavity in the housing receives rear-side acoustic radiation. The housing defines a rear sound-emitting opening. A support structure is configured to carry the housing on a user's head such that the housing is held proximate an ear of the user with one of the front or rear sound-emitting openings anterior of and proximate the tragus of the ear. The housing comprises an inner end wall that is configured to be closest to the user's head, and a curved sidewall that is configured to face the tragus. The one of the front or rear sound-emitting openings that is anterior of and proximate the tragus of the ear intersects both the curved sidewall and the end wall, extends along the curved sidewall, and lies at an angle to the inner end wall.

Examples may include one of the above and/or below features, or any combination thereof. The one of the front or rear sound-emitting openings that is anterior of and proximate the tragus of the ear may comprise the front sound-emitting opening in the housing. The open audio device may further include a separate rear sound-emitting opening in the housing that is configured to be farther from the tragus than is the front sound-emitting opening.

In another aspect, an open audio device includes a cylindrical housing and an acoustic radiator in the housing that emits front-side acoustic radiation from its front side and rear-side acoustic radiation from its rear side. A front acoustic cavity in the housing receives front-side acoustic radiation. The housing defines a front sound-emitting opening. A rear acoustic cavity in the housing receives rear-side acoustic radiation. The housing defines a rear sound-emitting opening. A support structure is configured to carry the housing on a user's head such that the housing is held proximate an ear of the user with the front sound-emitting opening anterior of and proximate the tragus of the ear. The housing comprises an inner end wall that is configured to lie against the user's head proximate the ear and anteriorly of the tragus, and a curved sidewall that is configured to be located proximate the tragus. The front sound-emitting opening is formed by a chamfer at an intersection of the sidewall and the inner end wall of the housing, and is located in part in the sidewall and in part in the inner end wall of the housing. There is a separate rear sound-emitting opening in the housing that is configured to be farther from the tragus than is the front sound-emitting opening.

DETAILED DESCRIPTION

Figure 1:
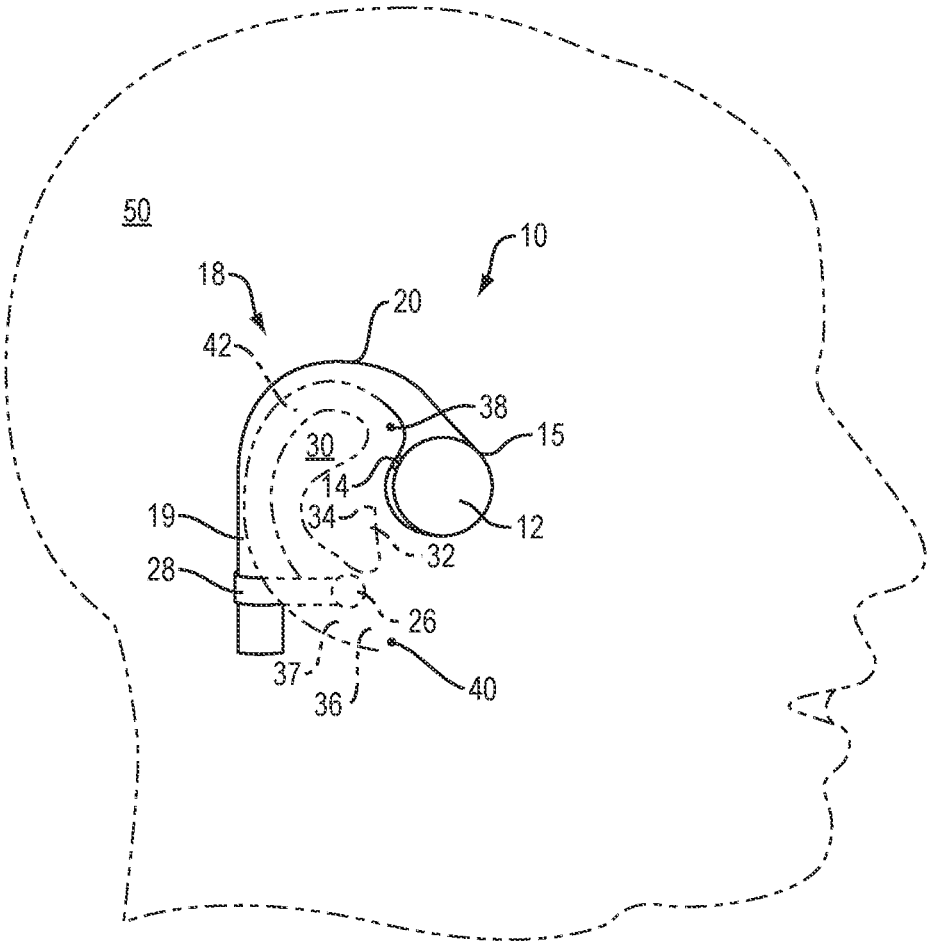
FIG. 1 is a side view of an open audio device mounted to the right ear of a user.

Open audio devices, such as those described in U.S. Patent Application Publication 2018-0167710, filed on Dec. 11, 2016 (the entire disclosure of which is incorporated herein by reference for all purposes) typically include an electro-acoustic transducer (i.e., a driver) with front and rear sides. In some non-limiting examples the front side sound exits the device near the user's ear canal, and the rear side sound exits farther from the user's ear canal. In other examples, the front side sound exits the device closer to the ear than does the rear side sound. At low frequencies the sound from the front and rear sides are nearly equal in amplitude and out-of-phase and so cancel in the far field such that the device behaves approximately like a dipole. Accordingly, little sound is spilled to people who may be nearby. The present disclosure includes an open audio device of the type described in the U.S. patent application publication that is incorporated by reference.

An electro-acoustic transducer includes an acoustic element (e.g., a diaphragm) that emits front-side acoustic radiation from its front side and emits rear-side acoustic radiation from its rear side. A housing or other structure directs the front-side acoustic radiation and the rear-side acoustic radiation. A plurality of sound-emitting vents in this structure (at least one in the front and at least one in the rear) allow sound to leave the structure. The electro-acoustic transducer is able to achieve an appropriate ratio of sound pressure delivered to the ear to spilled sound.

This disclosure describes a type of open audio device with one or more electro-acoustic transducers that are located off of the ear. A headphone refers to a device that typically fits around, on, or in an ear and that radiates acoustic energy into the ear canal. Headphones are sometimes referred to as earphones, earpieces, headsets, earbuds, or sport headphones, and can be wired or wireless. A headphone includes an electro-acoustic transducer (driver) to transduce electrical audio signals to acoustic energy. The acoustic driver may or may not be housed in an earcup. The figures and descriptions following show a single open audio device. A headphone may be a single stand-alone unit or one of a pair of headphones (each including at least one acoustic driver), one for each ear. A headphone may be connected mechanically to another headphone, for example by a headband and/or by leads that conduct audio signals to an acoustic driver in the headphone. A headphone may include components for wirelessly receiving audio signals. A headphone may include components of an active noise reduction (ANR) system. Headphones may also include other functionality, such as a microphone.

In an around the ear or on the ear or off the ear headphone, the headphone may include a headband or other support structure and at least one housing or other structure that contains a transducer and is arranged to sit on or over or proximate an ear of the user. The headband can be collapsible or foldable, and can be made of multiple parts. Some headbands include a slider, which may be positioned internal to the headband, that provides for any desired translation of the housing. Some headphones include a yoke pivotably mounted to the headband, with the housing pivotally mounted to the yoke, to provide for any desired rotation of the housing.

An open audio device includes but is not limited to an off-ear headphone, i.e., a device that has one or more electro-acoustic transducers that are coupled to the head or ear (typically by a support structure) but do not occlude the ear canal opening. In the description that follows the open audio device is depicted as an off-ear headphone, but that is not a limitation of the disclosure as the electro-acoustic transducer can be used in any device that is configured to deliver sound to one or both ears of the wearer where there are no ear cups and no ear buds. The audio device contemplated herein may include a variety of devices that include an over-the-ear hook, such as a wireless headset, hearing aid, eyeglasses, a protective hard hat, and other open ear audio devices.

Figure 2:
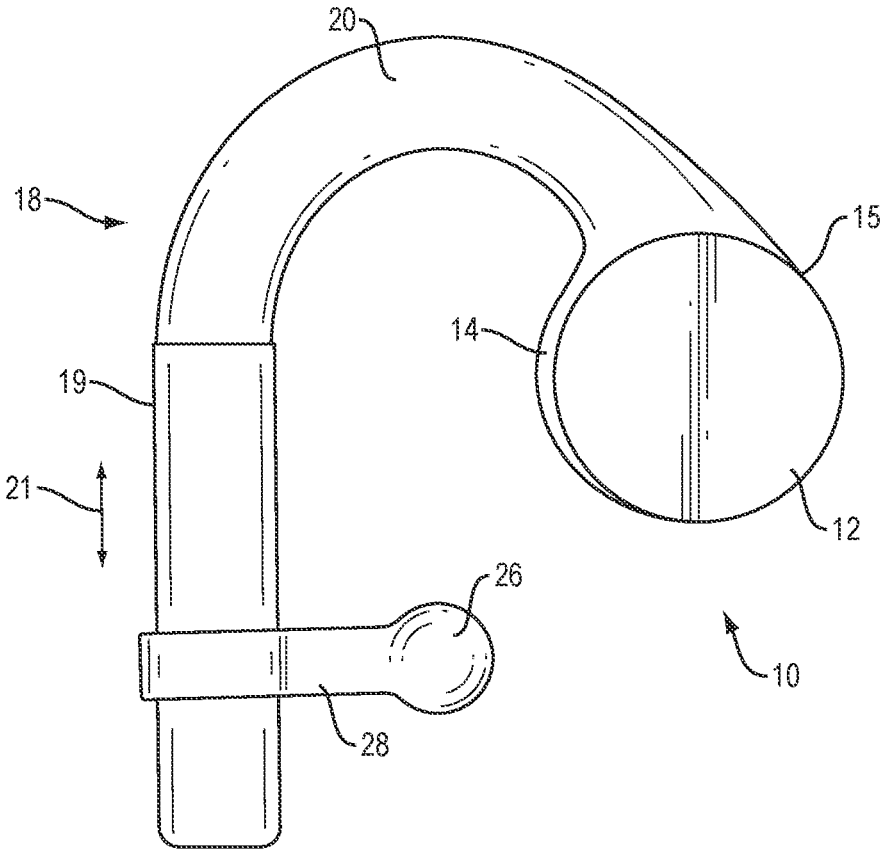
FIG. 2 is a side view of the open audio device of FIG. 1.

Exemplary audio device 10 is depicted mounted to an ear in FIG. 1 and is depicted off the ear in FIG. 2. Audio device 10 is carried on or proximate outer ear 30. Audio device 10 comprises acoustic module 12 that comprises an acoustic radiator (driver/transducer) carried in a housing. Acoustic module 12 is configured to locate a sound-emitting opening 14 anteriorly of and proximate to the ear canal opening 34, which is behind (i.e., generally underneath) ear tragus 32. Acoustic modules (which may include one or more electro-acoustic transducers or drivers) that are configured to deliver sound to an ear are well known in the field and so are not further described herein. Audio device 10 further includes body 18 that acts as a support structure that carries acoustic module 12 and is configured to be worn on or abutting outer ear 30 such that body 18 contacts the outer ear and/or the portion of the head 50 that abuts the outer ear. Arm 28 is coupled to body 18. Arm 28 is optional, but is one structure that can assist with holding audio device 10 on the ear. Arm 28 comprises a distal end 26 that is configured to contact at or near the ear root dimple 37 of the user. Arm 28 may be but need not be configured to be moved in two directions, e.g., in a vertical direction or up-and-down direction along the length of body 18 and in a horizontal direction, pivoting about the axis of the body 18. In some implementations, arm 28 is compliant. The adjustability and compliance (in implementations where the arm is compliant) of the arm allows arm distal end 26 to be located at the bottom of the outer ear of people with different anatomies. Force provided in part by the compliance of the arm can cause the body and arm to gently grip the outer ear and/or the ear root dimple region when the audio device is worn in this manner. The grip helps to maintain audio device 10 on the ear as the user moves. Arm 28 can be adjustable to allow the user to adjust audio device 10 so it fits comfortably but firmly on the ear.

Body 18 can at least in part be shaped generally to follow the ear root, which is the intersection of the outer ear and the head. Contact along the ear root or the outer ear and/or the head abutting the ear root (collectively termed the ear root region) can be at one or more locations along the ear root. However, since the human head has many shapes and sizes, body 18 does not necessarily contact the ear root of all users. Rather, it can be designed to have a shape such that it will, at least on most heads, contact the ear root region, at least near the top of the ear. In implementations that include arm 28, the arm distal end can be configured to contact the lower part of the ear root region. Since, at least for most heads, the audio device with the arm may contact the ear/head at least at these two spaced locations, which are substantially or generally diametrically opposed, the result is a gripping force that maintains audio device 10 on the head as the head moves. For implementations where the arm is compliant, the compliance of the arm can cause a slight compressive force at the opposed contact locations and so can help achieve a grip on the head/ear that is sufficient to help retain the device in place on the head/ear as the head is moved. In one non-limiting example, one contact location is proximate the upper portion of the outer ear helix, and the opposed contact location is proximate the lower part of the ear or abutting head, such as near the otobasion inferius 40. Contact near the otobasion inferius 40 can be accomplished in any desired manner, for example without an arm, or with an arm that is fixed in location, or with an arm that is fixed and compliant. Body 18 can include a protrusion (in place of the arm) that is configured to contact the ear root region proximate otobasion inferius 40. In one non-limiting example the opposed contact location is in or proximate the ear root dimple 37 that is located in most heads very close to or abutting or just posterior of the otobasion inferius 40. The audio device may be compliant at the portions that define each of two (or more) expected ear/head contact locations. For example, the body 18 of the audio device may include a compliant section at the contact location proximate the upper portion of the outer ear helix.

In one non-limiting example, audio device body 18 comprises a hollow molded plastic housing portion 19, which may be used to house internal electrical components, such as a battery and circuitry. Alternatively, portion 19 can be a metal housing (e.g., stainless steel) and can have a silicone overcoat to increase comfort using a material that is appropriate for contact with the skin. Arm 28 (when present) is coupled to body 18 (e.g., to body portion 19), and may be configured to be moved relative to body 18, and/or, in implementations where arm 28 is compliant, to bend. These movements and adjustments of arm 28 relative to body 18 allow arm distal end portion 26 to be located where desired relative to body 18. In some implementations, this allows distal end 26 to be located in or near the ear root dimple. This also allows the user to achieve a desired (and variable) clamping force of audio device 10 on the head and/or ear. In one non-limiting example, arm 28 is adjustable relative to body 18 to achieve the best fit and clamping force for the user. This adjustability of the arm is preferably but not necessarily at least up and down along the length of body portion 19, in the direction of arrow 21, FIG. 2. Also, the angular position of arm distal end 26 relative to body portion 19 can be made adjustable (e.g., to accommodate different positions of ear root dimples). Such adjustability can be accommodated by configuring the arm to bend and/or to rotate about the longitudinal axis of body portion 19. The horizontal and vertical position of arm distal end 26, and the amount of torque applied to body 18 via arm 28 and its distal end 26, can be made adjustable by configuring arm 28 such that it can be bent. Bending can be in one or both of the vertical direction and the horizontal direction. In one non-limiting example, both bending modes can be accommodated by fabricating the arm or another protrusion of an elastomer (such as a silicone or a thermoplastic elastomer) that can be bent or otherwise manipulated, for example up and down and side-to-side relative to the arm longitudinal axis. Horizontal bending can apply a torque to body 18, which can force acoustic module 12 against the head by pushing outward on the inside of the earlobe. This can help stabilize audio device 10 on the head. In some implementations, multiple sizes of arms 28 can be provided, having varying lengths of arm distal end 26. For example, a small, medium, and large size arm 28 may be used to accommodate various head/ear sizes.

Audio device body 18 can at least in part be shaped to generally follow the shape of the ear root. The anatomy of the ear and head adjacent to the ear, and manners in which an audio device can be carried on or near the ear, are further described in international patent application PCT/US18/51450 filed on Sep. 18, 2018, the entire disclosure of which is incorporated herein by reference for all purposes. Accordingly, not all aspects of the anatomy and fitting of an audio device to an ear are specifically described herein. Body 18 in this example includes generally "C"-shaped portion 20 that extends from an upper end (which when worn on the head may be proximate otobasion superius 38) where it is coupled to acoustic module 12, to a lower end where it is coupled to portion 19. While portion 19 is shown as a separate piece from the rest of body 18, in some implementations, portion 19 and the rest of body 18 may be integrally formed. In some implementations, some or all of body 18 is compliant. For example, the portion of body 18 that comes in contact with a wearer's ear/head may be compliant. Compliance can be accomplished in one or more mechanical manners. Examples include the choice of materials (e.g., using compliant materials such as elastomers or spring steel or the like) and/or a construction to achieve compliance (e.g., including a differentially-bending member in the construction). Generally, but not necessarily, body 18 (e.g., portion 20) follows the ear root from the otobasion superius 38 (which is at the upper end of the ear root) to about the otobasion posterius (not shown).

In implementations with arm 28, arm distal end 26 can be constructed and arranged to fit into or near the dimple or depression 37 (i.e., the ear root dimple) that is found in most people behind earlobe 36 and just posterior of the otobasion inferius 40. In some implementations, distal end 26 can be generally round (e.g., generally spherical as shown in the drawings), having an arc-shaped surface that provides for an ear root dimple region contact location along the arc, thus accommodating different head and ear sizes and shapes. Alternative shapes for distal end 26 include a half sphere, truncated sphere, cone, truncated cone, cylinder, and others. Arm distal end 26 can be made from or include a compliant material (or made compliant in another manner), and so it can provide some grip to the head/ear.

In some implementations, body portion 20 at or around the ear root region proximate the upper portion 42 of the outer ear helix (which is generally the highest point of the outer ear) has compliance. Since ear portion 42 is generally diametrically opposed to ear root dimple 37 (and to device portion 26 which contacts the ear root dimple), a compliance in body portion 20 will provide a gripping force that will tend to hold audio device 10 on the head/ear even as the head is moved.

Since the device-to-ear/head contact points are, at least for most users, both in the vicinity of the ear root (proximate upper ear upper portion 42 and in the vicinity of ear root dimple 37), the contact points are generally diametrically opposed. The opposed compliances create a resultant force on the device (the sum of contact force vectors, not accounting for gravity) that lies about in the line between the opposed contact regions. In this way, the device can be held stable on the ear even in the absence of high contact friction (which adds to stabilization forces and so only helps to keep the device in place). Contrast this to a situation where the lower contact region is substantially higher up on the back of the ear. This would cause a resultant force on the device that tended to push and rotate it up and off the ear. By arranging the contact forces roughly diametrically opposed on the ear, and by creating points of contact on either side of or over an area of the upper ear root ridge 42, the device can accommodate a wider range of orientations and inertial conditions where the forces can balance, and the device can thus remain on the ear.

Figure 3:
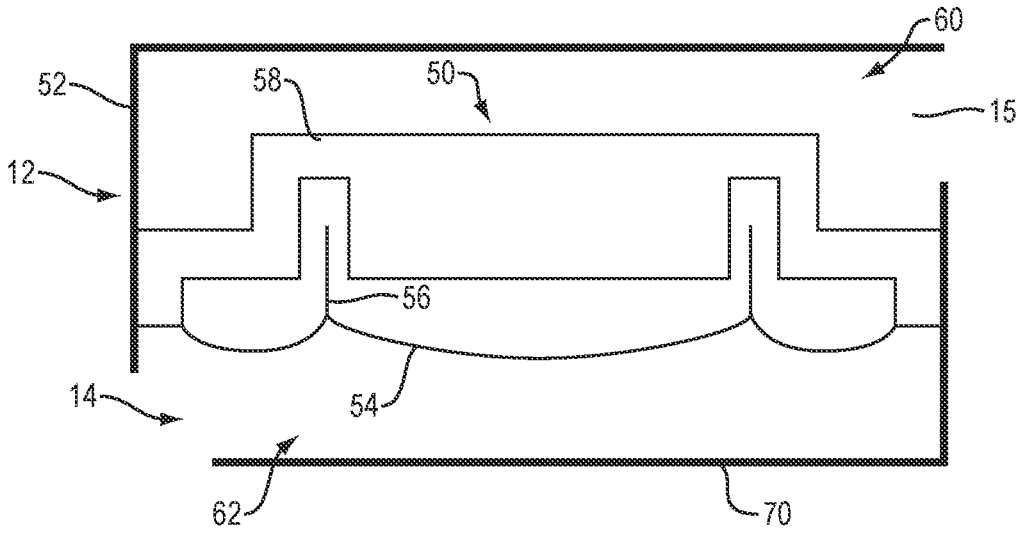
FIG. 3 is a schematic diagram of an acoustic module for an open audio device.
Figure 4:
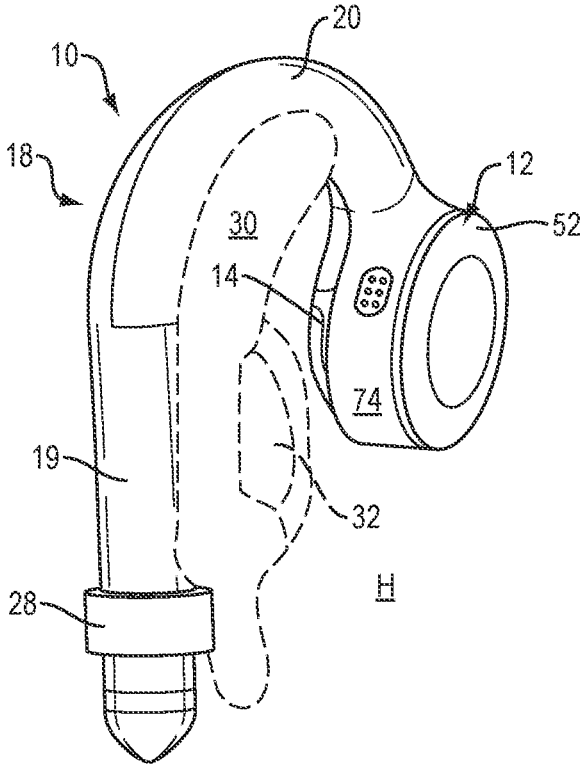
FIG. 4 is a rear perspective view of an open audio device mounted to the right ear of a user.

An exemplary dipole-like open audio device acoustic module 12 for audio device 10 is schematically depicted in FIG. 3. Acoustic module 12 includes transducer 50 that is located within housing 52. Transducer 50 comprises diaphragm 54 that is moved by interaction of coil 56 with a magnetic field generated by the magnetic system, represented generally as structure 58. Structure 58 may also include a basket. Structure 58 may be vented to the rear acoustic cavity 60, in one non-limiting example by one or more vent holes around the perimeter and/or through the magnet structure of structure 58 that are open to the underside of diaphragm 54 and to rear acoustic cavity 60. Electroacoustic transducer design and operation are well understood by those skilled in the field, for example as disclosed in the U.S. Patent Publication that is incorporated herein by reference, and so are not further described herein. Front-side acoustic radiation enters front acoustic cavity 62 and rear-side acoustic radiation (which is out of phase with the front side radiation) enters rear acoustic cavity 60. Sound exits front cavity 62 via front opening 14 and sound exits rear cavity 60 via rear opening 15. As described in more detail in the U.S. patent application publication that is incorporated by reference herein, since the sound exiting openings 14 and 15 is out of phase, it generally cancels in the far field. This dipole-like behavior leads to a reduction in spilled sound that can be heard by others who are near the user of audio device 10. Also, since opening 14 is close to the ear, its sound will mainly reach the ear before it is canceled by sound from opening 15. Accordingly, audio device 10 is enabled to both deliver sound to the user and reduce spilled sound that is able to be heard by others.

Figure 5:
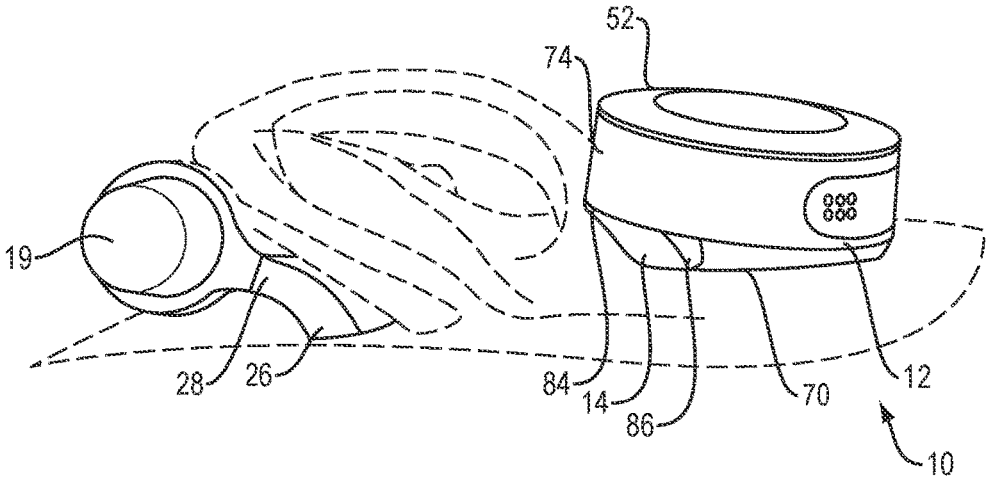
FIG. 5 is a bottom view of the open audio device of FIG. 4.
Figure 6:
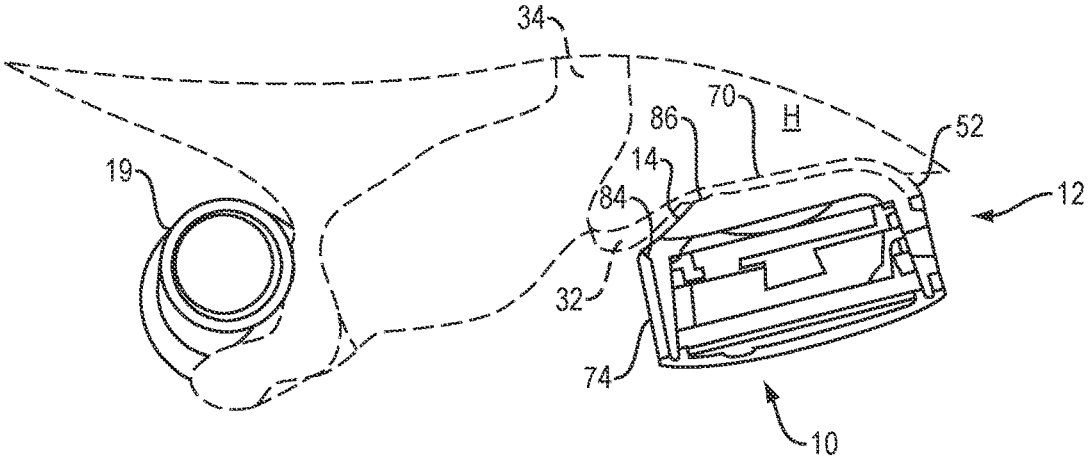
FIG. 6 is a cross-sectional view of the open audio device of FIGS. 4-5.

An exemplary open audio device 10 is shown in more detail in FIGS. 3-8. Housing 52 (see FIG. 3) carries acoustic radiator/transducer 50. Referring to FIGS. 3-6, front-side acoustic radiation from radiator 50 passes through front acoustic cavity 62 and exits the housing via front sound-emitting opening 14. Rear-side acoustic radiation from radiator 50 passes through rear acoustic cavity 60 and exits the housing via rear sound-emitting opening 15. There may be additional front and/or rear cavity openings, as would be understood by those skilled in the technical field, for example as disclosed in the U.S. Patent Publication that is incorporated herein by reference. Support structure 18 is configured to carry the housing on a user's head such that the housing is held proximate an ear 30 of the user, with the front sound-emitting opening 14 anterior of and proximate the tragus 32 of the ear. Alternatively, the arm could be configured to locate the rear sound emitting opening proximate the tragus. Referring to FIGS. 5 and 6, housing 52 comprises an inner end 70 that is configured to be closest to the user's head H. As shown in FIG. 6, front sound-emitting opening 14 lies at an angle to the inner end 70 of the housing.

Due to the angle of opening 14 relative to the inner end 70 of the housing and the dimensions of opening 14, opening 14 is configured to be positioned very close to ear tragus 32. Opening 14 has an opening height relative to the inner end 70 of the housing and is defined between an opening bottom edge 86 that is closest to the housing inner end 70 and an opening top edge 84 that is farther from the housing inner end. Opening bottom edge 86 is more anterior than the opening top edge 84. This creates an angled opening that is angled similarly to the angle of tragus 32, thus enabling opening 14 to be closer to tragus than a straight opening. In addition, as compared to an opening that is straight rather than angled, the angle increases the cross-sectional area of the opening. A larger opening area can reduce the effective acoustic resistance of a screen used to keep out contaminants. In some cases, the larger opening could also shift the cavity resonance higher in frequency and reduce flow velocity through the opening to achieve a more linear acoustic behavior. In one specific, non-limiting example, front opening 14 has an area of about 55 $mm^2$. More generally, at least in part the area of opening 14 can depend on the driver that is used. Generally, front opening 14 may have an area of no more than about 40% of the transducer's radiating area. Also, the angle of opening 14 places the entire opening closer to the ear canal than would a straight opening. When sound waves exit opening 14, they begin spreading roughly spherically. As such, the sound pressure level further from that opening falls off in an inverse proportion to the distance from the opening (i.e., 1/r where r is distance). Therefore, by having the opening closer to the ear canal, more sound pressure is delivered to the ear canal for the same transducer excursion.

In this non-limiting example, housing 52 is cylindrical. By cylindrical we mean generally cylindrical, meaning that it has top and bottom faces that are flat or generally flat (e.g., they may be domed or not exactly flat), and a curved sidewall. The sidewall may not be curved all the way around, and the radius of curvature may not be consistent. For example, the cylinder may have a general "D"-shape or a general oval shape, with the side facing the ear being more of a flattened curve than an actual cylindrical sidewall, which results in more of the length of opening 14 being positioned closer to the ear canal. Opening 14 is located at least in part in curved sidewall 74 and extends along the curved sidewall. The length of the opening along the circumference of the housing is in part dictated by the desired area of the opening and the maximum height of the opening given the placement of the driver and the configuration of the front acoustic cavity. In one non-limiting example opening 14 has a length such that it extends along no more than about 40% of the circumference of the sidewall (or no more than about 144 degrees around a cylindrical housing). One goal is to keep the length of the opening as short as possible along the circumferential direction of the sidewall so that sound exits close to the ear canal rather than farther away, where it would be more susceptible to being canceled by the rear sound before it reached the ear. In this non-limiting example opening 14 is formed by a chamfer at an intersection of the sidewall 74 and the inner end wall 70 of the housing. This locates opening 14 in part in the sidewall of the housing and in part in the inner end wall of the housing. Given that opening 14 needs to be open only to the front cavity and that the opening can't be configured to sit directly against the head, there is a limited area of the housing sidewall and inner end wall that can be devoted to the opening. In order to achieve a desired area of opening 14, its length along the circumference of the housing will in part depend on both the shape and circumference of the housing.

Figure 7:
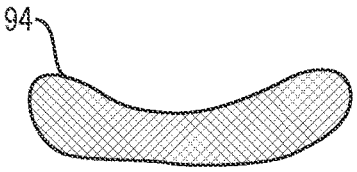
FIG. 7 is a side-view of the housing for the open audio device of FIGS. 4-6.
Figure 8:
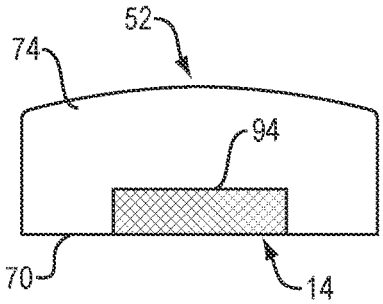
FIG. 8 illustrates a screen for a sound-emitting opening of the open audio device of FIGS. 4-7.

Screen 94, FIG. 7, can be but need not be located so as to cover opening 14. Screen 94 is designed to inhibit the ingress of contaminants (e.g., dust and moisture) while having little effect on the acoustic performance of the acoustic module. As shown in FIG. 8, screen 94 is curved along a length dimension to match the curved opening 14 (see FIGS. 4-5). Since opening 14 lies at least in part along the curved side of a cylinder, its overall shape is curved as in FIG. 8. Screen 94 is preferably configured such that it defines a developable surface, meaning it can lie on the curved surface that circumscribes opening 14 without buckling. Generally, when opening 14 is in part in a curved sidewall and in part in a flat end face of a cylindrical housing, screen 94 can be shaped around a conical surface such that its shape conforms to the shape of the opening and defines a developable surface. Screen 94 can be coupled to the housing using pressure sensitive adhesive, or any other manner such as by heat staking.

Acoustic module 12 also includes a separate rear sound-emitting opening 15 in housing 52. Rear sound-emitting opening 15 is configured to be farther from the tragus than is the front sound-emitting opening 14. This creates a dipole-like acoustic device, as explained above.

A number of implementations have been described. Nevertheless, it will be understood that additional modifications may be made without departing from the scope of the inventive concepts described herein, and, accordingly, other examples are within the scope of the following claims.

What is claimed is:

1. An open audio device, comprising:

a housing;

an acoustic radiator in the housing and that emits front-side acoustic radiation from its front side and emits rear-side acoustic radiation from its rear side;

a front acoustic cavity in the housing that receives front-side acoustic radiation, wherein the housing defines a front sound-emitting opening;

a rear acoustic cavity in the housing that receives rear-side acoustic radiation, wherein the housing defines a rear sound-emitting opening;

a support structure that is configured to carry the housing on a user's head such that the housing is held proximate an ear of the user with one of the front or rear sound-emitting openings anterior of and proximate the tragus of the ear;

wherein the housing comprises an inner end that is configured to be closest to the user's head;

wherein the one of the front or rear sound-emitting openings that is anterior of and proximate the tragus of the ear lies at an angle to the inner end of the housing; and wherein the one of the front or rear sound-emitting openings that is anterior of and proximate the tragus of the ear extends along an opening height relative to the inner end of the housing and is defined between an opening bottom edge that is closest to the housing inner end and an opening top edge that is farther from the housing inner end, and wherein the opening bottom edge is more anterior than the opening top edge.

2. The open audio device of claim 1, wherein the housing further comprises a sidewall that is configured to face the tragus.

3. The open audio device of claim 2, wherein the sidewall that is configured to face the tragus is curved.

4. The open audio device of claim 3, wherein the one of the front or rear sound-emitting openings that is anterior of and proximate the tragus of the ear extends along the curved sidewall of the housing.

5. The open audio device of claim 1, wherein the housing is cylindrical.

6. The open audio device of claim 5, wherein the inner end of the housing comprises an inner end wall that is configured to lie against the side of the user's head proximate the ear and anteriorly of the tragus, and wherein the housing further comprises a curved sidewall that is configured to be located proximate the tragus.

7. The open audio device of claim 6, wherein the one of the front or rear sound-emitting openings that is anterior of and proximate the tragus of the ear is formed by a chamfer at an intersection of the sidewall and the inner end wall of the housing.

8. The open audio device of claim 6, wherein the curved sidewall has a circumference, and wherein the one of the front or rear sound-emitting openings that is anterior of and proximate the tragus of the ear extends around no more than 40% of the sidewall circumference.

9. The open audio device of claim 6, wherein the one of the front or rear sound-emitting openings that is anterior of and proximate the tragus of the ear is located at least in part in the sidewall of the housing.

10. The open audio device of claim 9, wherein the one of the front or rear sound-emitting openings that is anterior of and proximate the tragus of the ear is also located in part in the inner end wall of the housing.

11. The open audio device of claim 1, wherein the one of the front or rear sound-emitting openings that is anterior of and proximate the tragus of the ear comprises the front sound-emitting opening in the housing.

12. The open audio device of claim 11, further comprising a separate rear sound-emitting opening in the housing.

13. The open audio device of claim 12, wherein the rear sound-emitting opening is configured to be farther from the tragus than is the front sound-emitting opening.

14. The open audio device of claim 1, further comprising a screen over the one of the front or rear sound-emitting openings that is anterior of and proximate the tragus of the ear, to inhibit the ingress of contaminants.

15. The open audio device of claim 14, wherein the screen is curved along a length dimension and defines a developable surface.

16. The open audio device of claim 1, wherein the one of the front or rear sound-emitting openings that is anterior of and proximate the tragus of the ear has an area of about 55 $mm^2$.

17. An open audio device, comprising:

a housing;

an acoustic radiator in the housing and that emits front-side acoustic radiation from its front side and emits rear-side acoustic radiation from its rear side;

a front acoustic cavity in the housing that receives front-side acoustic radiation, wherein the housing defines a front sound-emitting opening;

a rear acoustic cavity in the housing that receives rear-side acoustic radiation, wherein the housing defines a rear sound-emitting opening;

a support structure that is configured to carry the housing on a user's head such that the housing is held proximate an ear of the user with one of the front or rear sound-emitting openings anterior of and proximate the tragus of the ear;

wherein the housing comprises an inner end wall that is configured to be closest to the user's head and a curved sidewall that is configured to face the tragus; and wherein the one of the front or rear sound-emitting openings that is anterior of and proximate the tragus of the ear intersects both the curved sidewall and the end wall, extends along the curved sidewall, and lies at an angle to the inner end wall.

18. The open audio device of claim 17, wherein the one of the front or rear sound-emitting openings that is anterior of and proximate the tragus of the ear comprises the front sound-emitting opening in the housing, and further comprising a separate rear sound-emitting opening in the housing that is configured to be farther from the tragus than is the front sound-emitting opening.

19. An open audio device, comprising:

a cylindrical housing;

an acoustic radiator in the housing and that emits front-side acoustic radiation from its front side and emits rear-side acoustic radiation from its rear side;

a front acoustic cavity in the housing that receives front-side acoustic radiation, wherein the housing defines a front sound-emitting opening;

a rear acoustic cavity in the housing that receives rear-side acoustic radiation, wherein the housing defines a rear sound-emitting opening;

a support structure that is configured to carry the housing on a user's head such that the housing is held proximate an ear of the user with the front sound-emitting opening anterior of and proximate the tragus of the ear;

wherein the housing comprises an inner end wall that is configured to lie against the user's head proximate the ear and anteriorly of the tragus, and a curved sidewall that is configured to be located proximate the tragus, wherein the front sound-emitting opening is formed by a chamfer at an intersection of the sidewall and the inner end wall of the housing and is located in part in the sidewall and in part in the inner end wall of the housing; and a separate rear sound-emitting opening in the housing and that is configured to be farther from the tragus than is the front sound-emitting opening.

* * * * *